United States Patent [19]

Diener

[11] Patent Number: 4,583,271

[45] Date of Patent: Apr. 22, 1986

[54] METHOD AND APPARATUS FOR BURNISHING SPLINES AND GEARS USING SYNCHRONOUSLY ROTATED GEARS

[75] Inventor: Walter C. Diener, Leyden Township, Cook County, Ill.

[73] Assignee: Illinois Tool Works Inc., Chicago, Ill.

[21] Appl. No.: 489,646

[22] Filed: Apr. 28, 1983

[51] Int. Cl.[4] ..... B24B 39/04; B21H 5/02

[52] U.S. Cl. ..... 29/90 B; 72/108

[58] Field of Search ..... 29/90 R, 90 B; 409/8; 51/26; 72/108

[56] References Cited

U.S. PATENT DOCUMENTS

| | | | |
|---|---|---|---|
| 50,458 | 10/1865 | Cooper | 72/108 |
| 2,147,864 | 2/1939 | Thrun | 51/26 |
| 2,236,256 | 3/1941 | Allard | 29/90 |
| 2,245,654 | 6/1941 | Drader et al. | 51/26 |
| 2,423,593 | 7/1947 | Gasser | 51/287 |
| 2,942,389 | 6/1960 | Praeg et al. | 51/287 |
| 3,461,526 | 8/1969 | Motz et al. | 29/90 R |
| 3,894,418 | 7/1975 | Horl | 72/108 |
| 4,022,044 | 5/1977 | Szymber | 72/108 |
| 4,305,190 | 12/1981 | Flair | 29/90 B |
| 4,322,961 | 4/1982 | Greis | 72/108 |
| 4,414,780 | 11/1983 | Jorgensen | 29/90 R |

FOREIGN PATENT DOCUMENTS

| | | | |
|---|---|---|---|
| 2555583 | 7/1976 | Fed. Rep. of Germany | 72/108 |
| 46804 | 4/1968 | Japan | 72/108 |
| 392385 | 4/1933 | United Kingdom | 51/26 |

*Primary Examiner*—Leonidas Vlachos

*Attorney, Agent, or Firm*—David I. Roche; Thomas W. Buckman

[57] ABSTRACT

A burnishing machine and method employing a pair of oppositely disposed burnishing gears. The invention involves the use of two syncronously driven gears which operatively engage teeth on opposite sides of a spline or a gear. In one embodiment, for generally elongated articles, the axes of the workpiece and the gears are generally horizontal. In another embodiment for generally flat articles, the axes of the workpiece and the gears are generally vertical. In both embodiments the gears are rotated at an angular velocity sufficient to hold the workpiece translationally stationary. In the preferred embodiment the burnishing gears have different pressure angles and therefore burnish different portions of the workpiece tooth profile.

9 Claims, 6 Drawing Figures

METHOD AND APPARATUS FOR BURNISHING SPLINES AND GEARS USING SYNCHRONOUSLY ROTATED GEARS

BACKGROUND AND SUMMARY OF THE INVENTION

The present invention relates to the manufacture of toothed articles, and more particularly to a method and apparatus for removing minor defects in tooth surfaces.

In the manufacture of gears and splines, it is desirable to have tooth surfaces which are both hard and smooth in order to reduce wear and to insure a proper fit among machine components. In the manufacturing of splines it has been discovered that burnishing improves production by allowing more parts to be used, and improves performance of splines by insuring proper load distribution among the teeth.

Accordingly, it is an object of this invention to provide a method and apparatus which enables an operator to burnish gears and splines at increased rates of production.

It is a further object to provide an apparatus capable of handling various sized parts.

A further object is to provide a burnishing machine having fewer high precision parts.

Another object to provide a burnishing machine which insures proper engagement of a workpiece prior to the burnishing operation.

Yet another object is to provide a burnishing machine which has improved engageability with a workpiece.

These and other objects are achieved by the present invention wherein a pair of burnishing gears operatively engage opposite sides of a toothed workpiece. The gears are forceably urged towards the workpiece and rotated such that the workpiece is held against translation. One of the burnishing gears is pivotable to allow insertion and removal of a workpiece, and to allow workpieces of varying dimensions to be burnished. By using only two burnishing gears instead of the traditional three, significant benefits are obtained. There is the obvious benefit of fewer moving parts, not only the burnishing gears themselves but their supporting appurtenances as well. Also, by using only two gears, a machine can be adapted more easily to accommodate parts of different sizes because the gears need only be spread apart, and, since this is the way they ordinarily move, change-over is greatly simplified. Furthermore, translation of one of the gears while preventing rotation of the other causes a slight rotation of the first gear which facilitates engagement with a workpiece.

For a clearer understanding of the objects and benefits of the present invention reference should be made to the following specification read in conjunction with the accompanying drawings.

DESCRIPTION OF THE PREFERRED EMBODIMENTS

Figure 1:
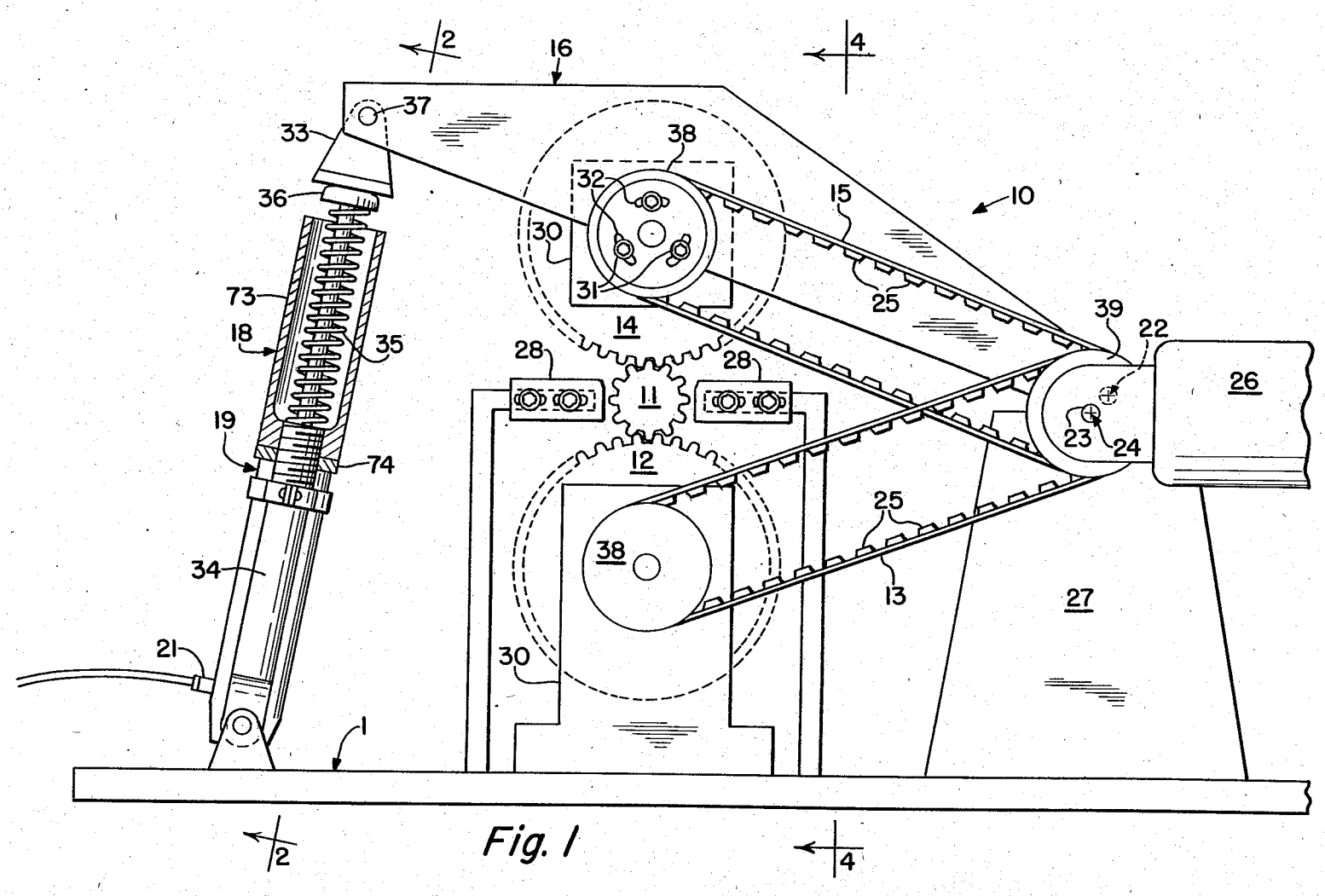
FIG. 1 is an elevational view in partial section of the preferred embodiment of the invention when used to burnish splines.

The apparatus 10 shown in FIGS. 1–4 includes a fixed burnishing gear 12 and a pivotable burnishing gear 14. The gears 12 and 14 are shown in contact with a workpiece 11. The axes of the gears and the workpiece are generally horizontal if the workpiece is a spline because it has been found that handling elongated articles is much easier when their axes are horizontal. The pivotable gear 14 is carried by an arm 16. One end of the arm is connected to a forcing means 18 comprised of a cylinder 19, a rod 17 and a piston (not shown) within the cylinder 19. The rod 17 is connected to the arm at a shaft 37. The other end of the arm 16 which carries the pivotable burnishing gear 14, pivots about a fixed axis 22 of the shaft 23. Movement of the arm 16 by actuation of the forcing means 18 allows insertion and removal of the workpiece 11.

The apparatus further includes a first toothed belt 13 which is adapted to rotate the fixed burnishing gear 12, and a second toothed belt 15 adapted to cause rotation of the pivotable burnishing gear 14. The toothed belts 13 and 15 are moved by a single rotating shaft 23. The belts have teeth 25 to prevent slip between gear pulleys 38 mounted on the spindle 30 and the driving pulleys 39 mounted on the driving shaft 23. A right angle driver 26 causes rotation of the shaft 23 about a rotation axis 24. The shaft 23 is supported by a supporting block 27 which is, in turn, mounted on a base 1. The base 1 also supports the fixed burnishing gear 12 as well as the pinned joint 20 at the base of the cylinder 19.

To facilitate insertion of the workpiece 11, it is preferable that the apparatus 10 have positioning means comprised of block 28 which are laterally adjustable and means for adjusting the relative positioning of the teeth of the gears 12 and 14. The position of the block 28 is adjusted such that the space between them is slightly larger than the diameter of the workpiece 11. Once the proper clearance is achieved between the blocks phase adjustment of the pivotable burnishing gear 14 is achieved by loosening the bolts 31 within the slots 32. By adjusting the position of the teeth of one of the burnishing gears relative to the other, and by proper adjustment of the block 28 an operator of the apparatus 10 can assure proper engagement of the gears 12 and 14 with the workpiece 11. Generally, the blocks are positioned so that a tooth on the workpiece 11 will align itself with a space on the pivotable burnishing gear 14 when the workpiece 11 is resting against one of the block 28. When the pivotable burnishing gear 14 engages the workpiece 11, the workpiece is lifted away from the block against which it was resting, and synchronous rotation of the gears 12 and 14 assures that no interference will occur between the workpiece 11 and the block 28. It has been found that by providing side clearance of approximately 0.010 inches on each side of the workpiece, splines having diameters of 1″ or less can be properly aligned.

A significant advantage of the present invention is the ease by which workpieces are engaged by the burnishing gears. Because toothed belts are used, translational movement of one of the gears, while preventing movement of the pulleys 39 and the driving shaft 23, causes rotation of the translating gear as it moves toward (or away from) the workpiece 11. As a result of the epicyclic motion of the teeth of the movable gear 14, meshing engagement of the moving gear with the workpiece is greatly facilitated. It should also be noted that timing chains of various designs could be used in place of the above described toothed belts. It is preferable, however, that positive engagement exist between the various belts or chains and their respective pulleys in order to maintain proper phase adjustment between the burnishing gears.

Figure 2:
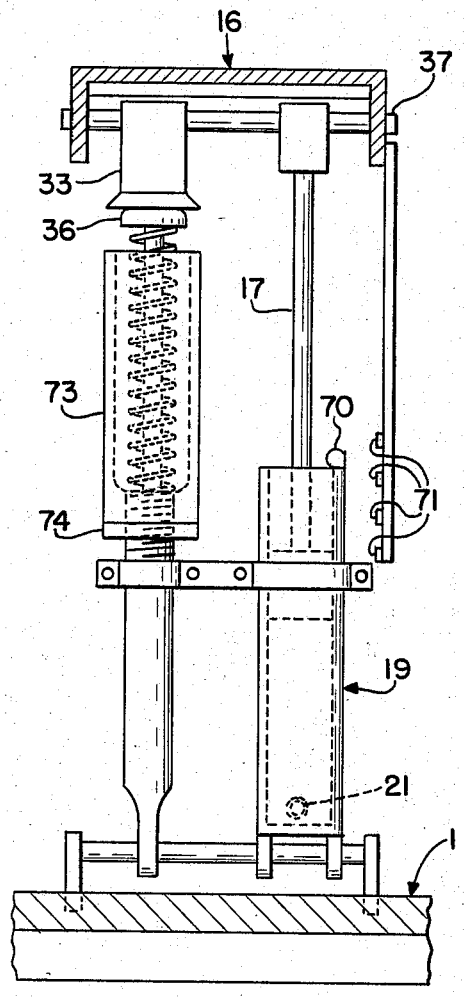
FIG. 2 is an elevational view taken along line II—II in FIG. 1.
Figure 3:
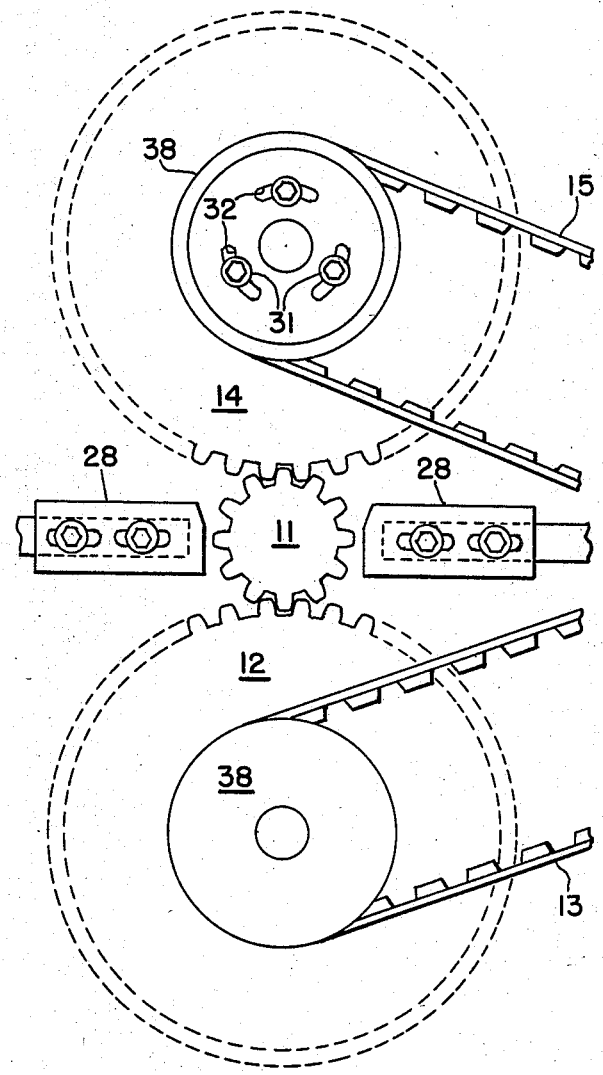
FIG. 3 is a detailed view of the positioning means of the present invention.

FIG. 2 is an end view of the apparatus 10. A shock absorber 34 is coupled to the cylinder 19 and a contact block 33 is keyed to a shaft 37 which is mounted to the arm 16. By keying the block 33 to the shaft 37 proper alignment between the shock absorber and the block 33 is assured. The shock absorber 34 has a head 36 which contacts the block 33 just prior to engagement between the gear 14 and the workpiece 11 to prevent impact therebetween. A spring 35 extends the shock absorber 34 upon disengagment of the gear 14 from the workpiece 11 in order to prevent impact of the gear 14 upon subsequent workpieces. An adjustable stop 73 and an adjusting nut 74 are threaded to the exterior of the shock absorber 34 to prevent over-travel of the movable gear 14.

Another feature of the apparatus of the present invention is a proximity sensor 70 which detects the presence of indicators 71 which signal the amount of deflection of the arm 16 relative to the cylinder 19. Depending upon which of the indicators 71 is being sensed, a different amount of pressure will be applied to the cylinder 19. Only when the gears 12 and 14 are in full meshing engagement with the workpiece 11 will full pressure be applied to the arm 16 via the cylinder 19. The proximity sensor 70 detects the amount of engagement of the gears with the workpiece 11 indirectly by measuring the amount of deflection of the arm 16 relative to the cylinder. 19. Until the sensor detects full engagement, a nominal amount of downward force is exerted by the cylinder 19 on the arm 16. When the sensor detects full engagement, a second greater amount of force is applied to the arm 16 and thus to the workpiece 11. Damage to the workpiece, which might occur as a result of improper meshing is therefore prevented. If a workpiece fails to be brought into place between the gears, the stop 73 will prevent interengagement of the gears 12 and 14 despite application of increase pressure.

Another significant feature of the present invention is that one of the gears 12 and 14 preferably has a pressure angle which is somewhat larger than that of the workpiece 11. The other of the gears 12 or 14 has a pressure angle which is less than that of the workpiece 11. The concept of using burnishing gears of different pressure angles is the subject of a patent assigned to the assignee of the present invention, and this patent U.S. Pat. No. 4,305,190 is incorporated herein by reference. It should be noted that by using gears of different pressure angles, the effective rolling diameter of otherwise similar diameter gears is different. As a result, it may be necessary that the point 22 about which the arm 16 pivots be non-concentric with the rotational axis of the shaft 23. This is due to the fact that gears having different pressure angles will have to be rotated at different distances from the workpiece in order to maintain the same angular velocity relative to the workpiece. Therefore, in order to maintain the workpiece 11 at a constant translational position, it may be necessary that the axis 24 of the shaft 23 be different from the axis about which the arm 16 rotates, when burnishing gears 12 and 14 have different pressure angles. Alternatively, however, gears of very different diameters may be used, and, as long as the net result of translational stability is achieved. This could be done by varying the size of the pulleys 38 associated with the burnishing gears. It has been found that by using gears having different pressure angles more efficient use of the burnishing machine can be made, because the work of the burnishing gears is distributed over different portions of the workpiece tooth profile. A burnishing gear having a high pressure angle will burnish the outer portions of the teeth of the workpiece, while a burnishing gear having a low pressure angle will burnish the inner portions of the teeth of a workpiece.

It should also be noted that to enable the apparatus 10 to burnish workpieces of various dimensions it may be necessary to make slight modifications. For example, the block 28 used to position the workpiece will have to be adjusted not only to provide proper spacing, but also to account for the arcuate pivoting movement of the gear 14.

Figure 4:
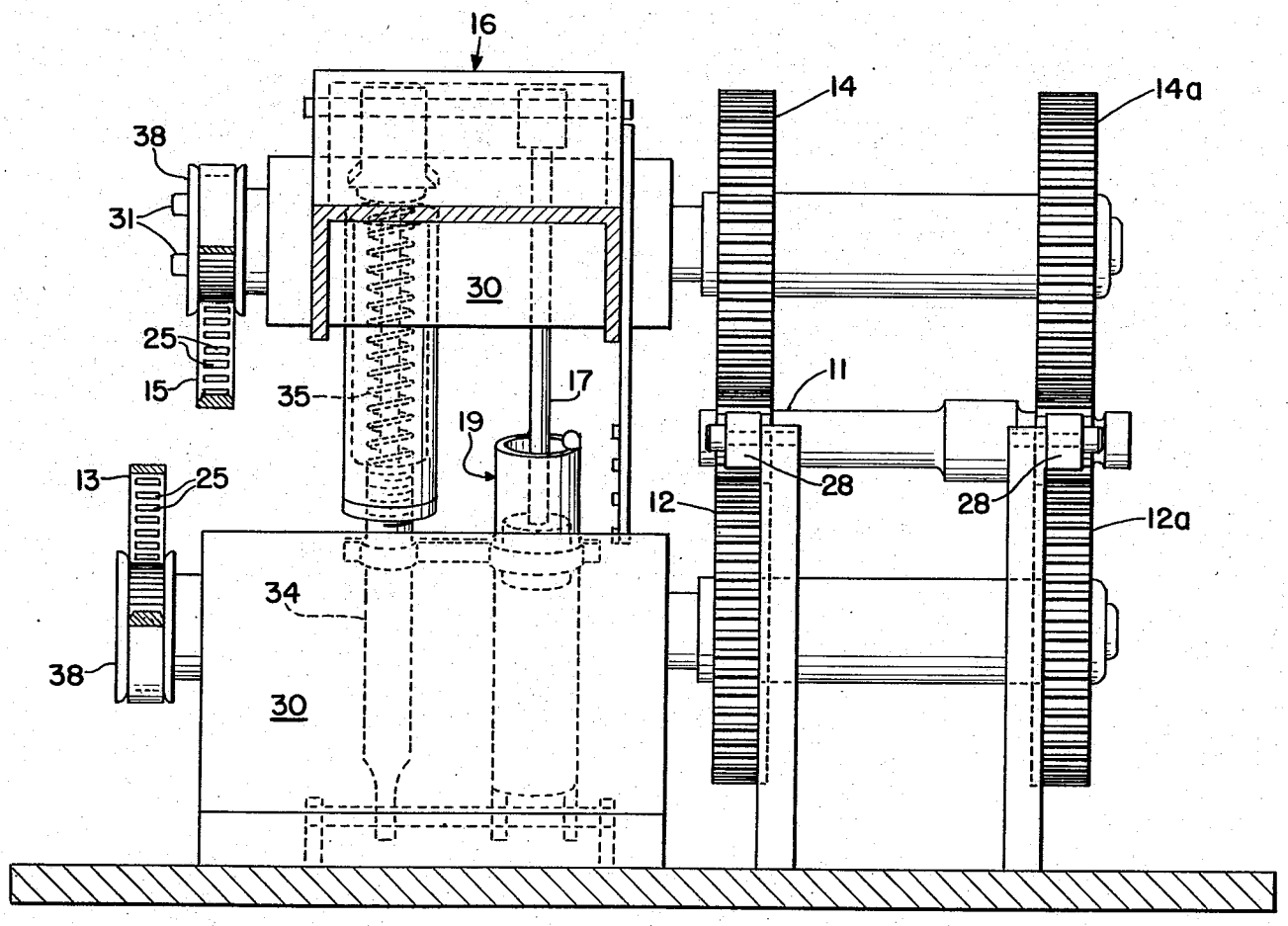
FIG. 4 is a sectional view taken along line IV—IV of FIG. 1.

In FIG. 4 the burnishing apparatus 10 is shown with an additional pair of burnishing gears **12*a* and 14*a*. The additional pair of burnishing gears may be brought into engagement with a different set of teeth on the workpiece 11. Engagement of the burnishing 14*a* with the workpiece 11 is preferably caused by actuation of the same power source which actuates the cylinder 19, in order to cause simultaneous engagement of the pivotable burnishing gears 14 and 14*a*. The power source which causes engagement of the pivotable burnishing gears is preferably a fluid power source connected via line 21 to the cylinder 19, and may be hydraulic or pneumatic for example. In the absence of a second set of burnishing gears the workpiece 11 may be supported by a bearing member (not shown) which may be a part of the conveyor system (not shown) which inserts and removes the workpiece 11. It should be noted that by using the arm 16 as a lever arm the effect of the forcing means 18 has a multiplied effect on the workpiece 11**.

Figure 5:
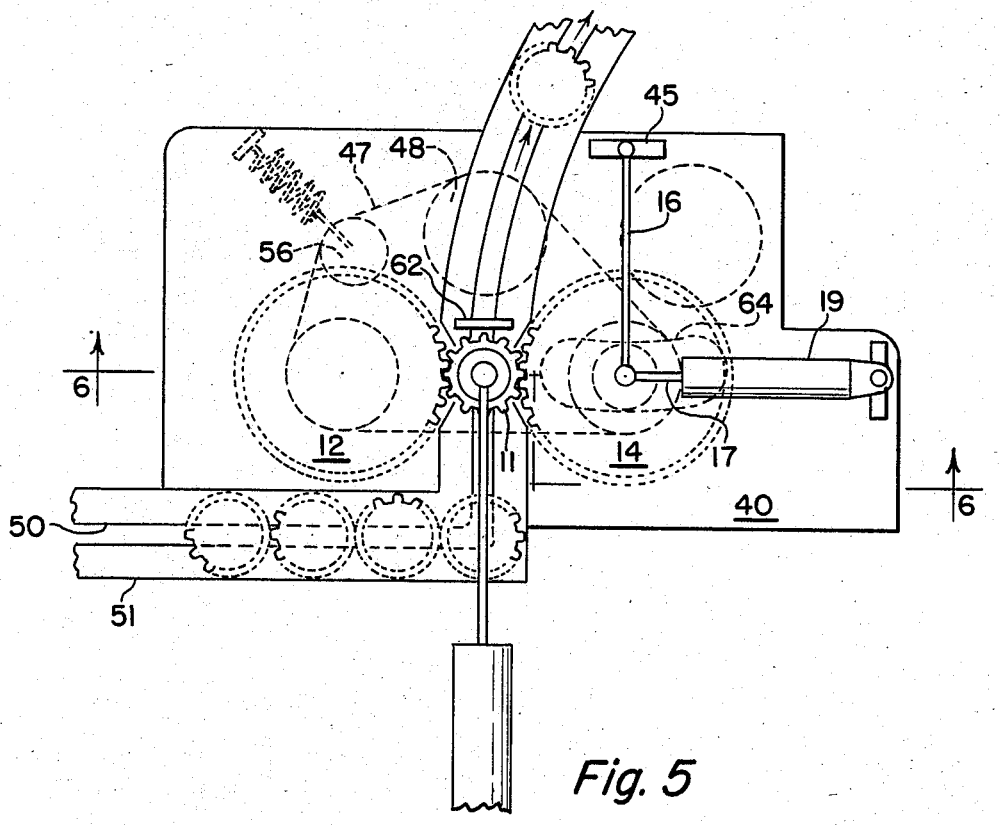
FIG. 5 is a plan view of the preferred embodiment of the invention when used to burnish gears.
Figure 6:
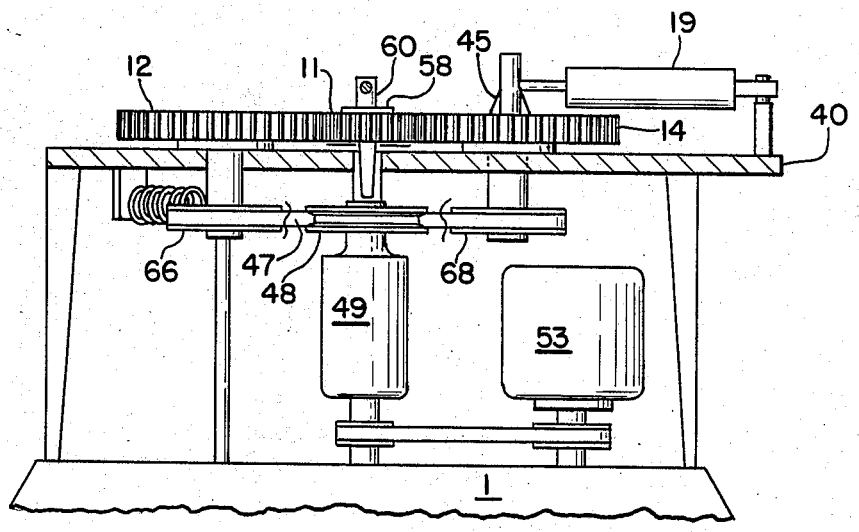
FIG. 6 is an elevational view of the apparatus shown in FIG. 5.

FIGS. 5 and 6 show an alternative embodiment of the present invention. The FIG. 5 is a plan view of an apparatus designed to burnish generally flat gears. In this embodiment the apparatus comprises a base 1 which carries a table 40 on which are mounted two burnishing gears 12 and 14. The fixed burnishing gear 12 lies on one side of the chute 51, and the pivotable burnishing gear 14 lies on the other side thereof. A cylinder 41 and rod 42 are adapted to engage a workpiece 11 and move it into position between the burnishing gears 12 and 14. A second cylinder 18 and rod 17 move the pivotable gear 14 into engagement with the workpiece 11. Synchronized rotation of the gears 12 and 14 is caused by a single toothed belt 47 which is rotated by a pulley 48 which is connected to a spindle 49 driven by a motor 53. The pivotable burnishing gear 14 is carried by an arm 16 which is connected to the table 40 at one end by a buttressed hinge 45. As the pivotable gear 14 moves in translation, slack in the toothed belt 47 may be taken up by a spring loaded pulley 56. In this way workpieces of various diameters may be burnished. It should be noted that the chute 51 may be modified to accept gears having integral elongated shafts, by providing a slot 50 in which the shaft may slide. It should also be noted that it may be desirable to provide a stop 62 to control the position of the workpiece 11 relative to the burnishing gears 12 and 14. Alternatively, the rod 42 may have an enlargement 60 on its end which engages a recess 58 in one side of the workpiece 11. Extension of the rod 42 may be carefully controlled to assure proper location of the workpiece 11 between the burnishing gears 12 and 14. It should be noted that because of the arcuate motion of the arm 16 the burnishing gear 14 moves along an arcuate path within a curved slot 64. An alternative to this arrangement would be to provide a generally straight slot and support the gear 14 within that slot without guidance of an arm 16.

In FIG. 6 it can be seen that the burnishing gears 12 and 14 are journaled within the table 40 and are driven by the toothed belt 47. The toothed belt 47 drives pulleys 66 and 68 which are connected to the opposite ends of the journals which carry the burnishing gears 12 and 14 respectively.

The above description of the preferred embodiments are examples of the many alternatives which are intended to be included within the spirit and scope of the appended claims.

I claim:

1. A burnishing apparatus comprising a pair of burnishing gears adapted to operatively engage teeth on generally diametrically opposite sides of a workpiece, the workpiece being unsupported other than by said gears during a burnishing operation, a first one of said gears being translationally fixed, a pivoting arm carrying the second one of said gears, and cylinder and piston connected to said arm for forcibly urging said gears toward each other and toward the workpiece, a rotating shaft with two belts for imparting simultaneous synchronized rotation to said gears at a velocity such that said workpiece is held translationally stationary while being rotated by said gears, means for holding the workpiece into engagement with said first one of said gears prior to engagement of the workpiece by said second of said gears, whereby pivoting of said arm causes generally epicyclic motion of said second gear teeth to facilitate its engagement with the workpiece.

2. An apparatus in accordance with claim 1 wherein said gears have tooth characteristics such that one of said gears has a pressure angle higher than that of the workpiece and performs work on outer portions of said teeth, and the other of said gears has a pressure angle lower than that of the workpiece and performs work on inner portions of said teeth.

3. An apparatus in accordance with claim 1 including positioning means comprised of a pair of blocks disposed on opposite sides of the workpiece, said blocks being adjustable to a variety of positions, and phase adjustment means for controlling the relative tooth alignment of said gears whereby substantially linear alignment of the workpiece and centers of said gears may be assured upon engagement of the workpiece by said gears.

4. A burnishing apparatus in accordance with claim 1 including at least one pair of additional burnishing gears adapted to forcibly engage opposite sides of the workpiece, said additional gears adapted to rotate in meshing engagement with teeth on the workpiece, rotation of said additional gears being dependent upon rotation of the workpiece and upon engagement therewith.

5. A burnishing apparatus in accordance with claim 1 in which the axes of the burnishing gears are generally horizontal whereby said apparatus is adapted to burnish generally elongated workpieces such as splines.

6. A method of burnishing a toothed workpiece comprising:

(a) placing the workpiece between and along a line generally coincident with the centers of a pair of burnishing gears, (b) holding the workpiece in engagement with one of said gears, (c) moving the teeth of the other of said gears in a generally epicyclic path into engagement with the workpiece, (d) supporting the workpiece only with said burnishing gears, (e) applying compressive force to the workpiece with said gears, (f) synchronously rotating said gears such that each tooth of the workpiece contacts at least one of said gears.

7. A method in accordance with claim 6 wherein one of said gears has a pressure angle higher than that of the workpiece and engages outer portions of teeth on the workpiece, and the other of said gears has a pressure angle lower than that of the workpiece and engages inner portions of said teeth, and said rotation is such that each tooth of the workpiece contacts each of said gears at least once.

8. A burnishing apparatus comprising a pair of burnishing gears adapted to operatively engage teeth on generally diametrically opposite sides of a workpiece, the workpiece being unsupported other than by said gears in directions perpendicular to the axes of said gears, a first one of said pair of gears being translationally fixed, a pivoting arm carrying the second of said gears, means at one end of said arm for forcibly urging said gears toward each other and toward the workpiece, said gears being driven by belts connected to a single rotating means for imparting simultaneous synchronized rotation to said gears at a velocity such that the workpiece is held translationally stationary while being rotated by said gears, means for holding the workpiece into engagement with said first one of said gears prior to engagement of the workpiece by said second of said gears, teeth of said second gear movable in a generally epicyclic path facilitate their engagement with the workpiece upon pivoting movement of said arm.

9. A burnishing apparatus in accordance with claim 8 wherein the axes of the burnishing gears are generally vertical whereby said apparatus is adapted to burnish generally flat workpieces such as gears.

* * * * *